US005880920A

United States Patent [19]

Fischer et al.

[11] Patent Number: 5,880,920

[45] Date of Patent: Mar. 9, 1999

[54] METHOD AND APPARATUS FOR CONTROLLING AN ELECTROMAGNETIC SWITCHING MEMBER

[75] Inventors: Werner Fischer, Heimsheim; Dietbert Schoenfelder, Gerlingen, both of Germany; Viktor Kahr, Milan, Italy; Davide De Giorgi, Esslingen/Bruehl, Germany; Kai-Lars Barbehoen, Ludwigburg, Germany; Hartmut Ressel, Reutlingen, Germany

[73] Assignee: Robert Bosch GmbH, Stuttgart, Germany

[21] Appl. No.: 824,853

[22] Filed: Mar. 26, 1997

[30] Foreign Application Priority Data

Mar. 26, 1996 [DE] Germany ..... 196 11 885.9

[51] Int. Cl.[6] ..... H01H 47/02

[52] U.S. Cl. ..... 361/187; 361/152; 361/160

[58] Field of Search ..... 361/152–156, 361/187, 160; 123/490

[56] References Cited

U.S. PATENT DOCUMENTS

| | | | |
|---|---|---|---|
| 4,653,447 | 3/1987 | Linder et al. . | |
| 4,970,622 | 11/1990 | Buechl | 361/154 |
| 5,053,911 | 10/1991 | Kopec et al. | 361/154 |
| 5,592,921 | 1/1997 | Rehbichler | 123/490 |

FOREIGN PATENT DOCUMENTS

| | | |
|---|---|---|
| 0 376 897 | 7/1990 | European Pat. Off. . |
| 44 20 282 | 12/1995 | Germany . |

*Primary Examiner*—Fritz Fleming
*Attorney, Agent, or Firm*—Kenyon & Kenyon

[57] ABSTRACT

A method and an apparatus for controlling an electromagnetic switching member having an excitation winding and a movable armature. A first time point and a second time point define a time window. Within the time window, the current characteristic and/or the voltage characteristic is evaluated in order to detect a switching time point at which the armature reaches a new limit position. The time window is enlarged if no reliable switching time point was detected within the time window.

12 Claims, 4 Drawing Sheets

METHOD AND APPARATUS FOR CONTROLLING AN ELECTROMAGNETIC SWITCHING MEMBER

FIELD OF THE INVENTION

The present invention relates to a method and an apparatus for controlling an electromagnetic switching member.

BACKGROUND INFORMATION

A method and apparatus for controlling an electromagnetic switching member are known from German Patent No. DE-OS 34 26 799 and from its corresponding U.S. Pat. No. 4,653,447. There, a method and an apparatus are described for controlling a solenoid valve that controls the fuel quantity to be injected into a diesel internal combustion engine. The solenoid valve comprises an excitation winding and a movable armature. To move the armature, a current and/or a voltage is applied to the excitation winding. Within a time window that is defined by a first value and a second value, the current characteristic and/or the voltage characteristic is evaluated in order to detect the time point at which the armature reaches its new limit position.

The time point at which the armature reaches its new limit position has a great influence on the accuracy of the fuel metering. For this reason, this time point must be reliably detected and distinguished from interference signals. With an excessively large time window, interference signals can be interpreted as the switching time point. With an excessively small time window, the switching time point does not lie within the time window in all operating states.

SUMMARY OF THE INVENTION

An object of the present invention is to reliably detect the time point at which the armature reaches its new limit position.

With the method and apparatus according to the present invention, the time point at which the armature reaches its new limit position can be reliably detected.

DETAILED DESCRIPTION

The method and apparatus according to the present invention are described based on the example of a solenoid valve that is used to control the fuel quantity to be injected into an internal combustion engine. In newer fuel metering systems, particularly for diesel internal combustion engines, solenoid valves are used to control the fuel metering. The time point at which the solenoid valve closes or opens determines the respective start or end of the fuel metering. In order to enable precise fuel metering, the closing time point and/or the opening time point of the solenoid valve must be reliably detected.

To control the fuel metering, the solenoid valve has either a current or a voltage applied to it.

Figure 1:
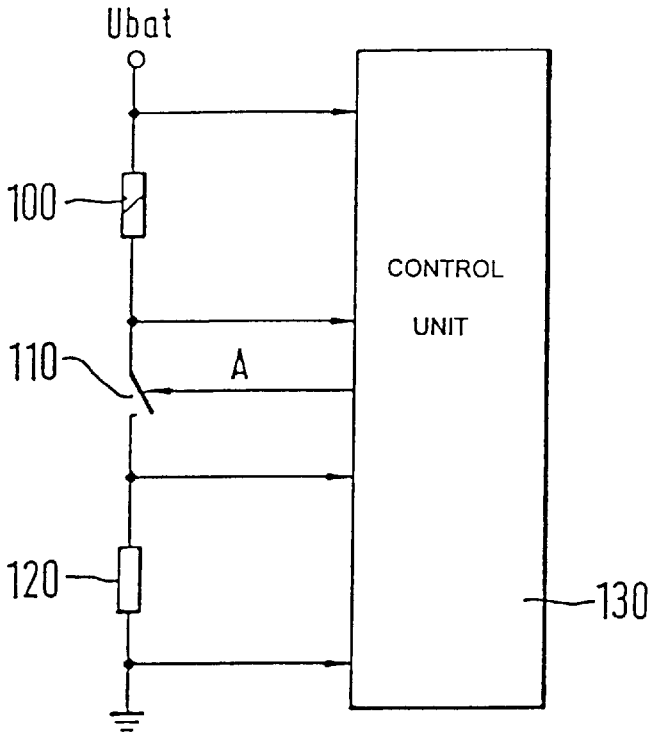
FIG. 1 shows a schematic representation of the apparatus according to an exemplary embodiment of the present invention.

A simplified representation of a circuit arrangement for such a solenoid valve is shown in FIG. 1. In FIG. 1, only the essential elements are shown. A coil of a solenoid valve is designated as 100. A switching device is designated as 110 and a measuring resistor as 120. The coil 100, the switching device 110 and the current measuring device 120 are connected in series between a supply voltage Ubat and ground. In the specific embodiment shown, the load is connected to the battery voltage and the switching device 110 is arranged between the coil 100 and the current measuring device 120.

The apparatus according to the present invention is not restricted to this arrangement. It can also be designed using other arrangements. For example, it is also conceivable that a second switching device connecting the coil 100 to battery voltage can be provided. Moreover, it is possible for the current measuring device 120 to be arranged between switching device 110 and the coil 100 or between the coil 100 and the supply voltage Ubat.

Moreover, a control unit 130 is provided. The control unit 130 is connected to the two terminals of the coil 100 as well as to the two terminals of the current measuring device 120. Moreover, the control unit 130 applies a control signal to the switching device 110.

Based on different measured operating parameters, the control unit 130 computes a control signal A for application to the switching device 110. Depending on this control signal A, a current flows through the coil 100, which current results in the solenoid valve assuming different positions and injection occurring.

Figure 2A:
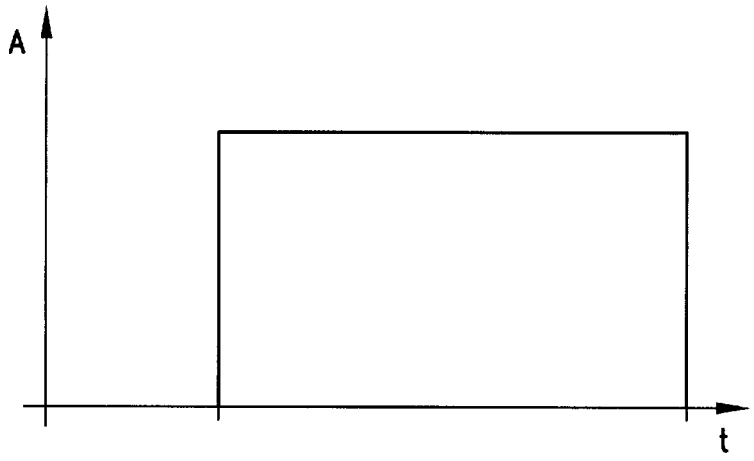
FIGS. 2*a–c* show graphic representations of various signals plotted vs. time t.
Figure 2B:
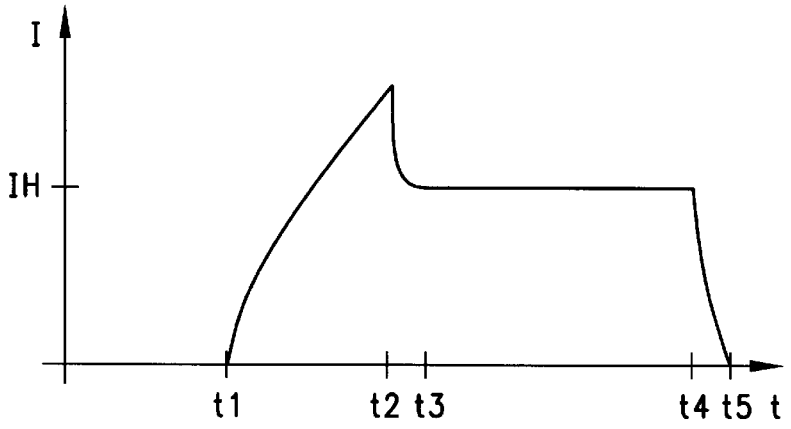
Figure 2C:
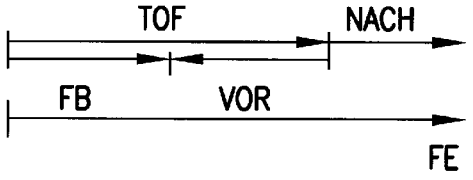

In FIG. 2, the control signal A and the current I that flows through the coil are plotted vs. time t. At time point t1, the control signal A goes from its low level to its high level. This results in the switching device 110 enabling the flow of current. The current I flowing through the coil 100 rises from this time point according to a defined function.

At time point t2, the free current rise is interrupted and a change made to current regulation. From this time point on, the current I is adjusted to the holding current IH. At time point t3, the current reaches the holding current IH. This current regulation takes place preferably through clocking of the switching device 110. At time point t4, the control signal A is withdrawn, which results in the current dropping to zero by time point t5.

It is provided according to the present invention that the time point t1 is chosen such that the current reaches the holding current IH before the solenoid valve reaches its new switching state.

Starting at time point t1, the time point is determined at which the solenoid valve reaches its new limit position by evaluating the voltage present on the solenoid valve. It is provided for this purpose that a time window is defined within which the switching time point presumably lies. The start of this time window is designated as FB and the end as FE.

In part c) of FIG. 2, the times at which the measurement window starts and ends are shown with arrows starting from the time point t1. The arrow TOF marks the time point at which the last switching time point was detected. Based on this time appoint TOF, the start of the measurement window FB is obtained by subtracting the time span VOR and the end of the measurement window FE is obtained by adding the time span NACH. The time point FB corresponds to the time point t1.

At the start of the measurement window FB, the current is adjusted to the holding current and simultaneously the program for detecting the switching point by evaluating the characteristic vs. time of the voltage on the coil 100 is started. This evaluation ends with the end FE of the measurement window.

If no switching time point is detected in this measurement window defined by the time points FB and FE, appropriate measures must be undertaken. A lack of the switching time point can be due on the one hand to the measurement window being too small or chosen in the incorrect time range.

Moreover, it is also possible that no solenoid valve driving took place or an error occurred.

The measurement window, particularly the start FR of the measurement window, cannot be chosen arbitrarily large since the start of the measurement window FE determines the time point at which the current is adjusted to the holding current. If this time point is chosen too early, the solenoid valve does not switch sufficiently fast or rather it does not switch at all.

If the time points t1 or t4 lie within the measurement window, they are detected as the switching time point.

Figure 3:
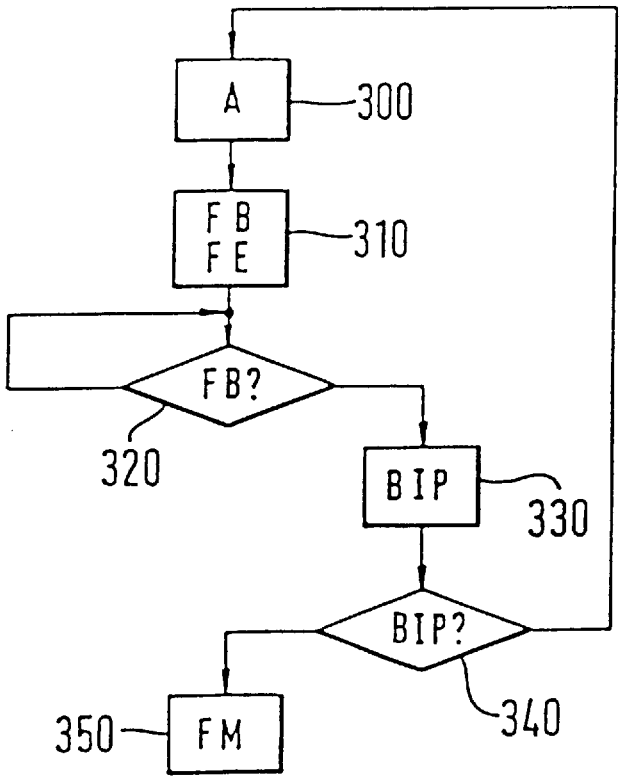
FIG. 3 shows a simplified flowchart for the method according to an exemplary embodiment of the present invention.

FIG. 3 shows a flowchart illustrating the procedure according to the present invention. In a first step 300, the control signal A is output. In the subsequent step 310, the start FR and the end FE of the measurement window are defined.

The window start FE is obtained from the time TOF of the last detected switching time point, minus the one first precontrol value VOR. If no switching time was yet detected in the previous solenoid valve drivings, a control value is used as a substitute value for computation.

The window end FE is computed from the time of the last detected switching time point TOF, added with a second precontrol value NACH. Analogous to the computation of the window start, a substitute value is used for the time TOF if no such time is yet available.

Figure 4A:
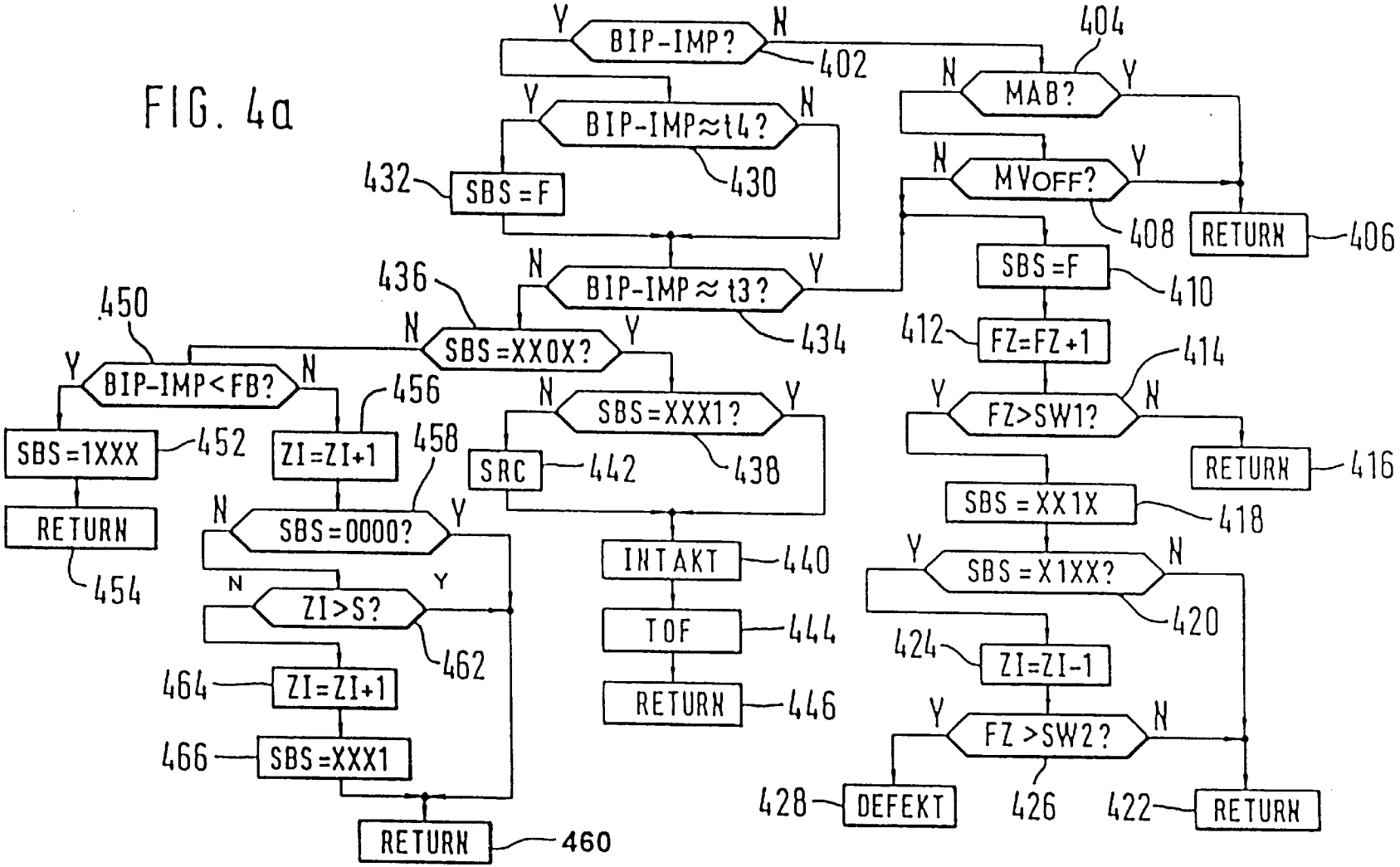
FIGS. 4*a* and 4*b* show detailed flowcharts for individual parts of the exemplary embodiment shown in FIG. 3.

The stipulation of the value FE is shown in greater detail in FIG. 4*a* in flowchart form. The next query 320 in FIG. 3 checks whether the start of the window FE is reached. If this is not the case, query 320 takes place anew. If the start of the window FE is reached, in step 330 the switching time point, also designated as BIP, is detected. For this purpose, in the shown exemplary embodiment, the current is adjusted to a defined value, the so-called holding current IH. The evaluation of the switching time point in step 330 takes place at the time point of the window end FE.

The holding current IH is dimensioned such that it is sufficient to hold the solenoid valve in its momentary position. This current is generally less than the current that is required to bring the solenoid valve into its new position.

To detect the switching time point BIP, in the shown exemplary embodiment the voltage on the solenoid valve is evaluated. As soon as the characteristic vs. time of the voltage exhibits a discontinuity, a signal is generated that is designated as BIP-IMP. Evaluation generally takes place in the output stage that is a part of the control unit 130.

Figure 4B:
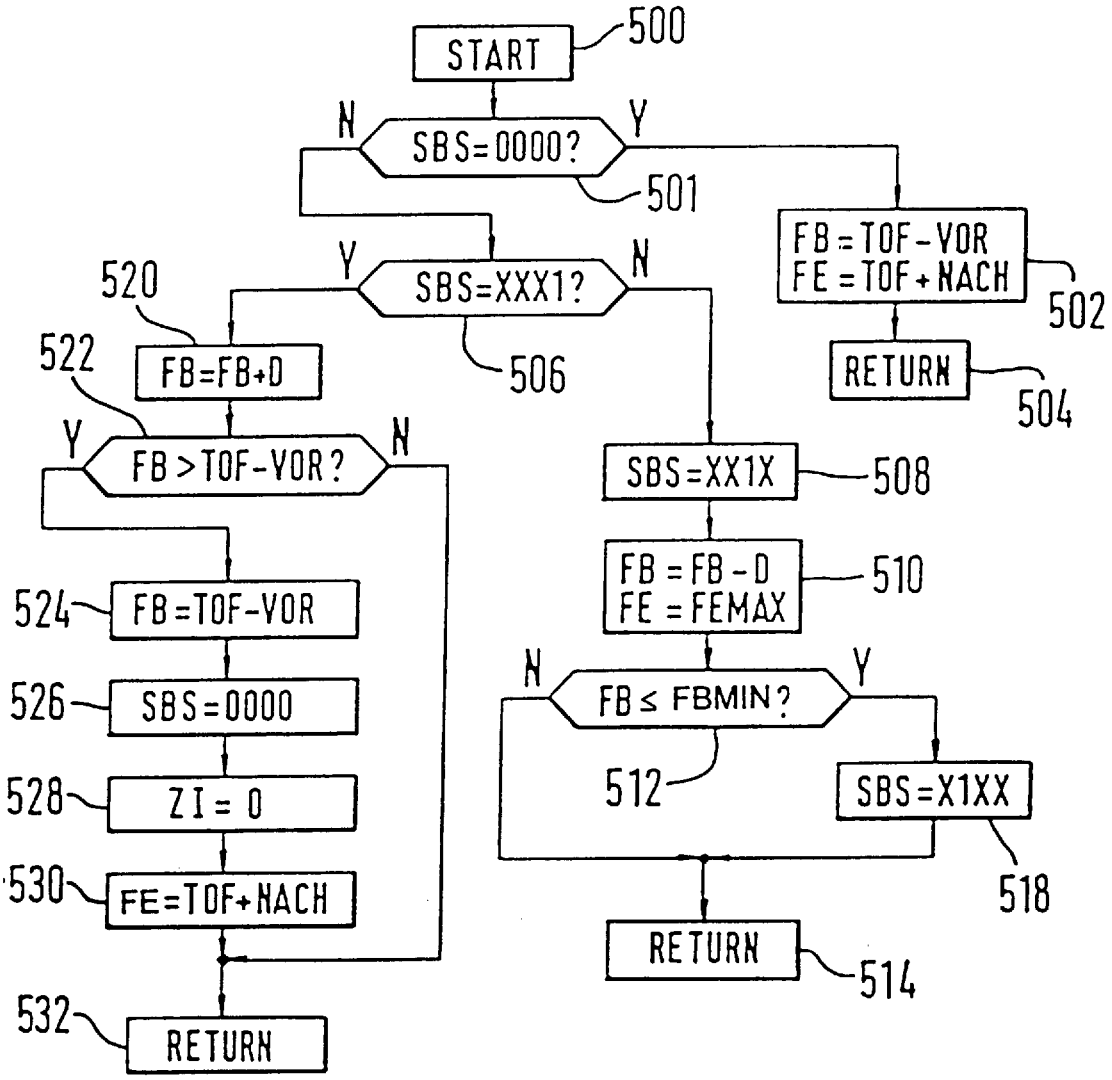

The query 340 checks whether the BIP-IMP was reliable. If this is not the case, in step 350 error FM is acknowledged. Otherwise, program execution starts anew with step 300 during the next metering. The query 340 is shown in FIG. 4*b* in greater detail.

Moreover, at the window end FE, insofar as a switching time point was detected within the window defined by the values FB and FE, this impulse is checked with regard to its plausibility. For diagnostics and for further evaluation, the result of the check is stored in a memory.

To check the plausibility of the switching time point BIP-IMP, one proceeds as shown in FIG. 4*a*. The flowchart in FIG. 4*a* represents only a possible specific embodiment. Various steps can also be left out, added or processed in another order. The values of the status memory SBS can also be chosen differently.

A first query 402 checks whether a switching time point BIP-IMP occurred in the measurement window. If this is not the case, a query 404 checks whether a so-called MAB signal is present. This MAB signal indicates that an external solenoid valve switch-off signal is present. This means that a signal is present that indicates that the solenoid valve is not being driven. When the MAB signal is present, no switching time point can be detected since the solenoid valve has no current applied to it.

If this is the case, in step 406 a return to the main program according to FIG. 3 occurs again. In the return in step 406, the return takes place without a switching time point having been detected during proper operation.

If no MAB is active, the query 408 follows, which checks whether the solenoid valve MV is switched off. If this is the case, a return to the main program in step 406 occurs. If the query 408 detected that the solenoid valve was not switched off, then no switching time point was detected although one should have been detected as a result of the operating conditions.

Thus, in step 410 a status memory SBS is set to an appropriate value that indicates that no switching time point occurred in the measurement window. Subsequently, in step 412 an error counter FZ is incremented by 1.

The subsequent query 414 checks whether the error counter FZ is greater than a first threshold SW1. If this is not the case, a return to the main program according to FIG. 3 occurs without further reaction in step 416. If the error counter FZ is greater than the threshold SW, in step 418 the status memory SBS is set to an appropriate value. This value indicates that a so-called BIP search is to be initiated. For this purpose, the third location of the memory is set to 1.

The subsequent query 420 checks whether the second location of the status memory SBS is set to 1. If this is not the case, the program returns in step 422 to the main program.

If the query 420 detects that the status memory SBS is set to 1 at its second location, then this indicates that the window has its maximum size. In this case, in step 424 a counter ZI is decreased by 1. The subsequent query 426 checks whether the error counter is greater than a second threshold SW2. If this is the case, the program ends in step 428 and acknowledges a defect. In this case, there is a defect in the metering system since no switching time point BIP-IMP was detected even for the largest possible window. Otherwise, the program returns in step 422 to the main program. In the return in step 416, the return to the main program takes place on the condition that no BIP-IMP was found although one should have been present.

If no switching time point is found repeatedly, the BIP search is activated in step 418. If the window reaches a certain size without a switching time point being found, the method acknowledges a defect.

In the return in step 422, the status memory is set so that the BIP search is still active.

If the query 402 detects that a switching time point was detected, then the query 430 checks whether the switching time is on the order of magnitude of the switch-off time t4. If this is the case, the status memory SBS is set to an appropriate value that indicates that no switching time point was detected.

If the query 430 detected that the switching time point BIP-IMP was present in the range of the switch-off time point t4 of the solenoid valve, then the query 434 is processed just like after step 432. This query 434 checks whether the switching time point BIP-IMP lies in the range of the switch-over time t3 at which the switch-over to holding current occurs. If this is the case, then step 410 follows in which the status memory SBS is set to an appropriate value. If this is not the case, i.e., the detected switching time point BIP-IMP lies between the times t3 and t4, the query 436 follows.

The query 436 checks whether the status memory SBS is set to a value that indicates that the window search is inactive or terminated. This means that the query 436 checks whether the third location of the status memory SBS is filled with the value zero. If this is the case, i.e., the window search is inactive or rather terminated, then the query 438 takes place. This query 438 checks whether the status memory SBS is filled such that it indicates that the window should be reduced. If this is the case, then step 440 follows directly.

If this is not the case, i.e., the window search is not active and the window is not being reduced, then a signal range check follows in step 442. This means that it is checked whether the value of the switching time point does not deviate by more than a difference value from an expected value. For example, the value TOF can be used as the expected value. The difference value is defined preferably as a function of the supply voltage.

If the found value does not deviate from the expected value, then step 440 follows likewise in which the switching time point was detected as intact. If step 440 is reached, then a reliable switching time point was detected. Subsequent to step 440, in step 444 the time point TOF is redetermined through filtering. The filtering is arranged such that a sliding average value is formed over a certain number of plausible measured values. Subsequently, a return to the main program occurs in step 446. This return takes place particularly if the switching time point was properly detected without a BIP search.

If the query 436 detected that the BIP search was active, i.e., that the status memory SBS was set appropriately, then the query 450 follows. The query 450 checks whether the BIP-IMP occurred earlier than expected. This means that it is checked whether the BIP-IMP lies before the window start FB. If this is the case, then in step 452 the status memory SES is set such that the search window is enlarged. This takes place, for example, in that the first location of the status memory is set to 1.

Subsequently, in step 454 the return to the normal main program takes place. In this return, the status memory is set so that the window search is active and the window is to be enlarged.

If the query 450 detected that the switching time point BIP-IMP was not earlier than expected, then step 456 follows in which the counter ZI is incremented by 1. In this case, the switching time point is found and lies within the measurement window defined by the values FB and FE. In the counter ZI, the renumber of found switching time points is counted. The subsequent query 458 checks whether the BIP search is still active. If this is not the case, then the return to the main program follows in step 460.

If the query 458 detects that the BIP search is active, then the query 462 checks whether the counter status ZI is greater than the threshold S. If this is the case, then the return to the main program takes place in step 460. If the counter status ZI is still not greater than the threshold S, then it is incremented in step 464. Subsequently, in step 466 the status memory SBS is set such that the window is reduced. Subsequently, the return to the main program takes place in step 460.

In FIG. 4*b*, the subprogram of step 340 for adaptation of the window size is shown. After the program is started in step 500, the query 501 follows. It checks whether the status memory assumes the value zero. If this is the case, i.e., the window search is not active, i.e., the BIP window is found and has its smallest size, then step 502 follows. This means in step 502 the start of the window FB is determined based on the time TOF and the precontrol value VOR. Analogously, the window end FE is defined based on the time TOF and the time NACH. This means that the two values FE and FB that define the window are set to their normal values. Subsequently, the return to the main program takes place in step 504.

If the query 501 detects that the status memory SBS is not equal to zero, then the query 506 follows, which checks whether the fourth location of the status memory SBS assumes the value 1. This indicates that the window is to be reduced. If this is not the case, then step 508 follows in which the status memory SBS is set such that it indicates that the BIP search is active and the window is to be enlarged. This takes place in that the first and the third location of the status memory SBS are set to 1.

In step 510, the start of the window FB is reduced by a certain value D, i.e., the window is enlarged, and the window end is set to its maximum value FEMAX. The query 512 checks whether the window, particularly the window start, has reached its minimum value FBMIN. If this is not the case, the return to the main program follows in the next step 514. If the maximum size is reached, in step 518 the status memory SBS is set to a value that indicates that the maximum window size is reached. For this purpose, the second memory cell is set to 1. Subsequently, the return to the main program takes place in step 514.

Using this procedure, particularly in the steps 510 and 512 it is achieved that the first time point (FB) is gradually reduced until reaching a minimum value (FBMIN) and that the second time point (FE) is immediately enlarged to the maximum value (FEMAX) if no allowable switching time point was detected within the time window.

If the query 506 detected that the status memory SBS is set such that the window is to be reduced, then this reduction takes place in step 520 in which a specifiable value D is added to the window start time. The subsequent query 522 checks whether the window start time FB is greater than the time TOF minus VOR, i.e., it is checked whether the window start FE has approached sufficiently close to the switching time point. If this is not the case, then the return to the main program takes place in step 532.

If this is the case, i.e., the window has reached its normal value TOF-VOR, then in step 524 the window start FB is set to the normal value TOF-VOR. Subsequently, in step 526 the status memory SBS is set to zero. In step 528, the counter ZI is reset to zero. Subsequently, in step 530 the window end FE is set to the value TOF+NACH. Subsequently, the return takes place in step 332. In this return, the window has its normal size and the search is no longer active.

Using this procedure, particularly through the steps 520 to 530 it is achieved that upon detection of an allowable switching time point, the first time point (FB) is gradually increased until a normal value is reached and that upon reaching the normal value for the first time point (FR), the second time point (FE) is set to its normal value.

What is claimed is:

1. A method for controlling an electromagnetic switching member having an excitation winding and a movable armature, comprising the steps of:

defining a time window using a first time point and a second time point;

evaluating within the time window at least one of a current characteristic and a voltage characteristic in order to detect a switching time point at which the moveable armature reaches a new limit position; and enlarging the time window if a reliable switching time point is not detected within the time window.

2. The method according to claim 1, wherein the second time point defines an end of the time window and is immediately enlarged to a maximum value if the reliable switching time point is not detected within the time window.

3. The method according to claim 1, further comprising the step of determining a stored switching time point as a function of the reliable switching time point being filtered.

4. The method according to claim 1, wherein the reliable switching time point is detected if all conditions of a monitoring function are fulfilled.

5. The method according to claim 1, further comprising the step of determining the first time point based on a stored switching time point and a first precontrol value.

6. The method according to claim 1, further comprising the step of determining the second time point based on a stored switching time point and a second precontrol value.

7. A method for controlling an electromagnetic switching member having an excitation winding and a movable armature, comprising the steps of:

defining a time window using a first time point and a second time point, evaluating within the time window at least one of a current characteristic and a voltage characteristic in order to detect a switching time point at which the moveable armature reaches a new limit position; and enlarging the time window if no reliable switching time point is detected within the time window, wherein the first time point defines a start of the time window and is gradually decreased until reaching a minimum value if the reliable switching time point is not detected within the time window.

8. A method for controlling an electromagnetic switching member having an excitation winding and a movable armature comprising the steps of:

defining a time window using a first time point and a second time point;

evaluating within the time window at least one of a current characteristic and a voltage characteristic in order to detect a switching time point at which the moveable armature reaches a new limit position; and enlarging the time window if no reliable switching time point is detected within the time window.

wherein the first time point is gradually increased to a normal value if the reliable switching time point is detected within the enlarged time window.

9. The method according to claim 8, wherein upon reaching the normal value for the first time point, the second time point is set to another normal value.

10. An apparatus for controlling an electromagnetic switching member having an excitation winding and a movable armature, a first time point and a second time point defining a time window, comprising an evaluation arrangement evaluating within the time window at least one of a current characteristic and a voltage characteristic in order to detect a switching time point at which the movable armature reaches a new limit position; and a control unit enlarging the time window if a reliable switching time point is not detected within the time window.

11. An apparatus for controlling an electromagnetic switching member having an excitation winding and a movable armature, a first time point and a second time point defining a time window, the apparatus comprising:

an evaluation arrangement evaluating within the time window at least one of a current characteristic and a voltage characteristic in order to detect a switching time point at which the movable armature reaches a new limit position; and a control unit enlarging the time window if a reliable switching time point is not detected within the time window, wherein the first time point defines a start of the time window, and wherein the control unit gradually decreases the first time point until reaching a minimum value if the reliable switching time point is not detected within the time window.

12. An apparatus for controlling an electromagnetic switching member having an excitation winding and a movable armature, a first time point and a second time point defining a time window, the apparatus comprising:

an evaluation arrangement evaluating within the time window at least one of a current characteristic and a voltage characteristic in order to detect a switching time point at which the movable armature reaches a new limit position; and a control unit enlarging the time window if a reliable switching time point is not detected within the time window, wherein the control unit gradually increases the first time point to a normal value if the reliable switching time point is detected within the enlarged time window.

* * * * *